US012295458B2

(12) United States Patent
Wang

(10) Patent No.: US 12,295,458 B2
(45) Date of Patent: May 13, 2025

(54) SHOE COUNTER STRUCTURE

(71) Applicant: Zilong Wang, Guangdong (CN)

(72) Inventor: Zilong Wang, Guangdong (CN)

( * ) Notice: Subject to any disclaimer, the term of this patent is extended or adjusted under 35 U.S.C. 154(b) by 2 days.

(21) Appl. No.: 18/233,881

(22) Filed: Aug. 15, 2023

(65) Prior Publication Data

US 2024/0324727 A1 Oct. 3, 2024

(30) Foreign Application Priority Data

Mar. 29, 2023 (CN) ..... 202320662002.1

(51) Int. Cl.
*A43B 23/08* (2006.01)
*A43B 11/00* (2006.01)

(52) U.S. Cl.
CPC ..... *A43B 23/088* (2013.01); *A43B 11/00* (2013.01); *A43B 23/08* (2013.01)

(58) Field of Classification Search
CPC ..... A43B 23/088; A43B 23/08; A43B 11/00
USPC ..... 36/68, 69, 72 B, 73
See application file for complete search history.

(56) References Cited

U.S. PATENT DOCUMENTS 199,574 A * 1/1878 Richardson ..... A43B 23/16 36/68
516,832 A * 3/1894 Packard ..... A43B 23/16 36/77 R
638,879 A * 12/1899 Packard ..... A43B 23/17 36/73
912,579 A * 2/1909 Krech et al. ..... A43B 23/28 36/68
1,086,673 A * 2/1914 Koppe ..... A43B 23/28 36/68
1,174,619 A * 3/1916 Scholl ..... A43B 23/28 36/68
2,298,035 A * 10/1942 Colella ..... A43B 23/16 36/68
3,613,274 A * 10/1971 Willey ..... A43B 23/17 36/58.5
4,622,764 A * 11/1986 Boulier ..... A43B 23/17 36/68
4,642,916 A * 2/1987 Collins ..... A43B 23/08 36/58.6
5,985,383 A * 11/1999 Allen ..... B29D 35/146 525/218
6,041,524 A * 3/2000 Brooks ..... A43B 13/41 36/71
6,079,128 A * 6/2000 Hoshizaki ..... A43B 23/16 36/89
2003/0196354 A1* 10/2003 Chu ..... A43B 5/003 36/34 R (Continued)

*Primary Examiner* — Marie D Bays

(57) ABSTRACT

A shoe counter structure, having a cross sectional shape curved as a C-shape; an inner upper portion of a support frame of the shoe counter structure is provided with a U-shaped clamping portion; two sides of the clamping portion are inclined outwardly towards two sides of the shoe counter structure, a middle part of the clamping portion is recessed inwardly towards a rear side of the shoe counter structure to form a first tendon accommodating groove. The support frame provides stable supporting force for the shoe counter, and the U-shaped clamping portion improve the alignment of the shoe counter with the ankle of the user.

6 Claims, 7 Drawing Sheets

(56) References Cited

U.S. PATENT DOCUMENTS

| | | | | |
|---|---|---|---|---|
| 2005/0138846 | A1* | 6/2005 | O'Connor | A43B 23/30 36/72 B |
| 2012/0180341 | A1* | 7/2012 | Crowley, II | A43B 13/223 36/83 |
| 2012/0216422 | A1* | 8/2012 | Ikezawa | A43C 1/00 36/83 |
| 2016/0249708 | A1* | 9/2016 | Boag | A43C 13/00 36/72 B |
| 2017/0027285 | A1* | 2/2017 | Mancini | A43B 23/28 |
| 2019/0082770 | A1* | 3/2019 | Takabu | A43B 3/244 |
| 2022/0240625 | A1* | 8/2022 | Shin | A43B 23/028 |
| 2022/0248800 | A1* | 8/2022 | Lambertz | A43B 7/1464 |
| 2023/0284748 | A1* | 9/2023 | Weeks | A43B 11/02 |

* cited by examiner

SHOE COUNTER STRUCTURE

BACKGROUND OF THE INVENTION

The present invention relates to the technical field of shoes, and more specifically relates to a shoe counter structure.

At present, there are several common ways to design a shoe collar, including: 1) A U-shaped collar substantially defined by a quarter and a tongue of the shoe, and tightening means such as shoe laces or hook and loop fasteners are also provided to loosen or tighten the shoe upper; 2) a shoe upper formed as an integral structure, such that the collar is defined by one piece of elastic material for easy widening of the collar during wearing and taking off of the shoe, while providing tightening effect of the collar once the shoe is worn, and an example of which is a knitted shoe upper; 3) a widened collar mostly seen in leather shoes for easy wearing and taking off of the shoe, but during wearing, the heel of the user will easy slip out of the collar. In the prior art, and more specifically in leisure shoes or sports shoes, it is usually required to pull a heel tab of the shoe in order to wear it, and this is inconvenient for people who have difficulties in bending down their bodies, like the elderly or those who are pregnant. Due to quicker pace of urban living, the demands for quicker wearing of shoes also increase.

In view of the above, CN115769930A discloses an elastic shoe counter, its manufacturing method, and a shoe thereof, wherein a step platform is provided at a foot entry portion; when a user's heel steps on the step platform, the step platform is elastically compressed so that user's foot can easily slip into the shoe; also, a top part of the shoe counter is prevented from being collapsed inwardly into the shoe which may otherwise affects the efficiency of wearing the shoe. After the elastic shoe counter is connected with an upper of the shoe, the shoe as resulted enables quick wearing. This kind of elastic shoe counter is not limited to be used by specific types of shoes, and is therefore suitable for use in sports shoes and leisure shoes. Because the shoe counter is soft and elastic, it is also comfortable to wear. However, certain problems were found after this kind of elastic shoe counter was used for a period of time: Firstly, this kind of shoe counter is absent of a tough and rigid support and so it can easily age and deform after a long period of use, particularly, an outer edge of the shoe counter can be easily folded by user's foot during wearing, thereby failing to achieve the intended purpose of quick wearing of the shoe; secondly, the step platform provided in the shoe counter does not sufficiently align with the foot and therefore cannot provide stable support for the ankle.

BRIEF SUMMARY OF THE INVENTION

In view of the aforesaid disadvantages now present in the prior art, the present invention provides a shoe counter structure to solve the problems mentioned above.

The object of the present invention is achieved according to the following technical solutions:

A shoe counter structure, wherein a cross sectional shape of the shoe counter structure is curved as a C-shape; said shoe counter structure comprises a support frame and a protective lining adhered to and covering an inner side of the support frame; an inner upper portion of the support frame is provided with a U-shaped clamping portion; two sides of the clamping portion are inclined outwardly towards two sides of the shoe counter structure, a middle part of the clamping portion is recessed inwardly towards a rear side of the shoe counter structure to form a first tendon accommodating groove.

Further, an upper edge of the shoe counter structure is bent outwardly.

Further, a second tendon accommodating groove which is recessed towards the rear side of the shoe counter structure is formed below the clamping portion.

Further, an outer side of the shoe counter structure is evenly arranged with a plurality of anti-slippery stripe projections.

Further, each of the anti-slippery stripe projections tapers towards two ends thereof.

Further, an outer side of the shoe counter structure is evenly arranged with a plurality of hexagonal pyramids.

Further, a lower portion of the support frame is evenly distributed with a plurality of air holes.

Further, a U-shaped airbag is provided inside the clamping portion.

Further, a thickness of two ends of the U-shaped airbag is greater than a thickness of a middle part of the U-shaped airbag.

The present invention has the following beneficial effects: Firstly, during use, the support frame provides stable supporting force for the shoe counter structure, so that after a long period of use, the shoe counter will not vastly collapse, thereby facilitating quick wearing of a shoe; secondly, the clamping portion is provided with a first tendon accommodating groove so that the Achilles tendon of a user's foot can be accommodated within the tendon accommodating groove, and thus the clamping portion is more aligned with the ankle of the user, and due to increased supporting force to the ankle, the chance for having a twisted ankle can be reduced; thirdly, the clamping portion can provide a certain clamping force at a lower end of the ankle, thereby preventing the foot from easily slipping out of the shoe.

REFERENCE SIGNS IN THE FIGURES

1—shoe counter structure; 2—support frame; 201—air holes; 3—protective lining; 4—clamping portion; 5—first tendon accommodating groove; 6—anti-slippery stripe projections; 7—second tendon accommodating groove; 8—hexagonal pyramids; 9—air bag.

DETAILED DESCRIPTION OF THE INVENTION

The present invention is further described in detail below with reference to some embodiments and the accompanying drawings.

Embodiment 1

Figure 1:
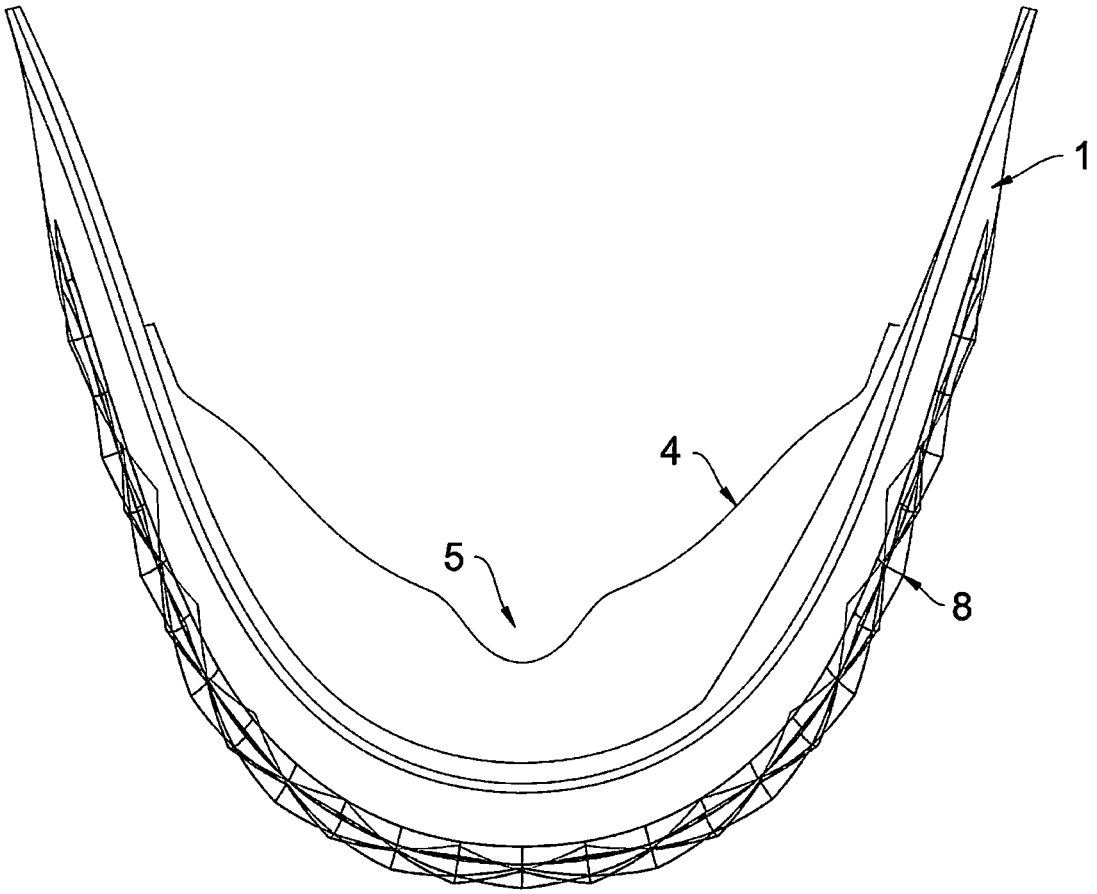
FIG. 1 is a top plan view of the shoe counter structure according to an embodiment of the present invention.
Figure 2:
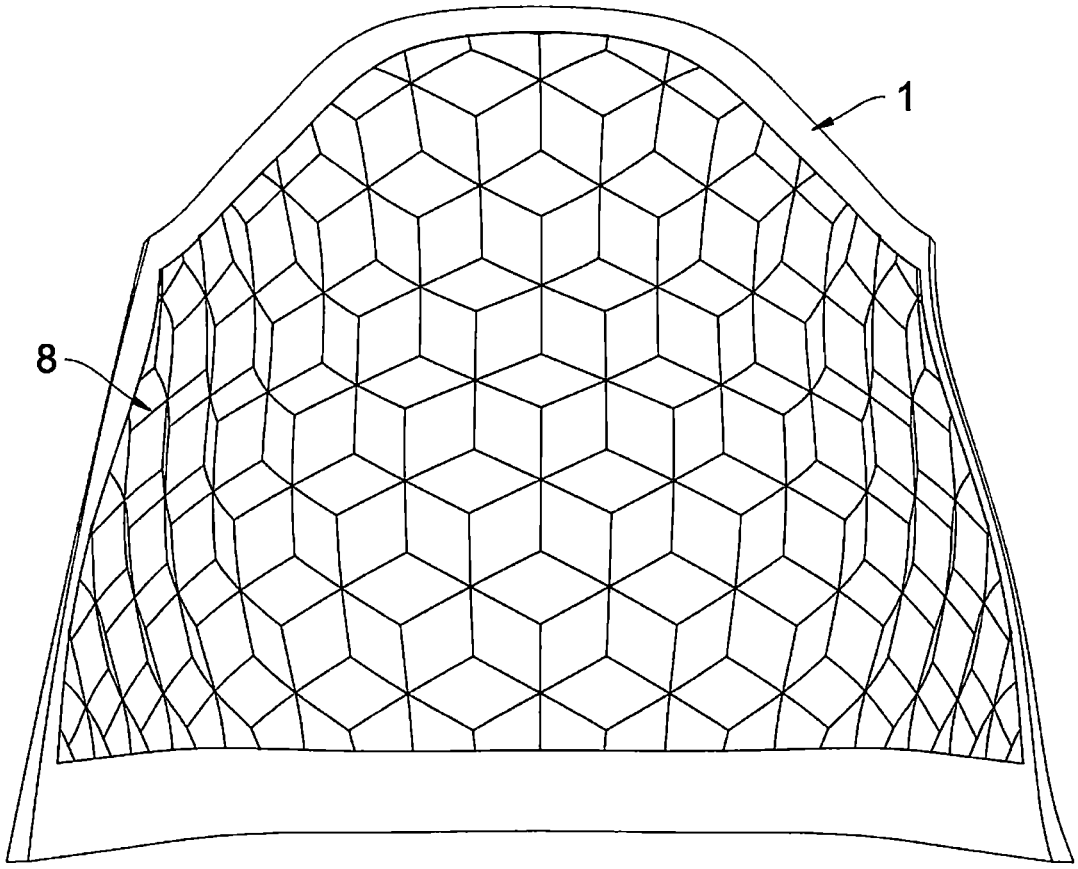
FIG. 2 is a front view of the shoe counter structure according to an embodiment of the present invention.
Figure 3:
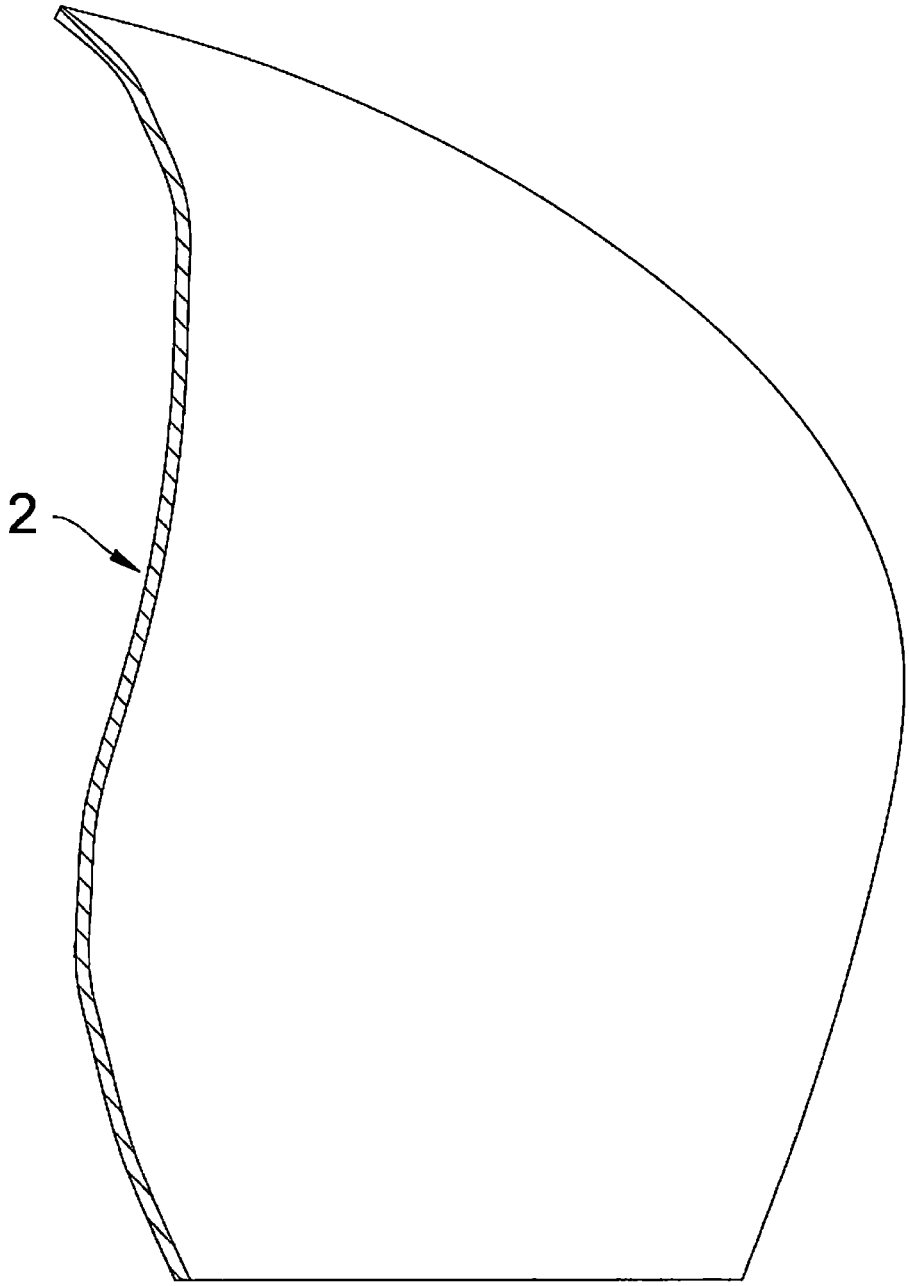
FIG. 3 is a sectional view of the support frame of the shoe counter structure according to an embodiment of the present invention.

With reference to FIGS. 1-3, a shoe counter structure 1 is provided, wherein a cross sectional shape of the shoe counter structure 1 is curved as a C-shape; said shoe counter structure 1 comprises a support frame 2 and a protective lining 3 adhered to and covering an inner side of the support frame 2; an inner upper portion of the support frame 2 is provided with a U-shaped clamping portion 4; two sides of the clamping portion 4 are inclined outwardly towards two sides of the shoe counter structure 1, a middle part of the clamping portion 4 is recessed inwardly towards a rear side of the shoe counter structure to form a first tendon accommodating groove 5. The clamping portion 4 is made of any one of the following commonly used prior art materials: plastic foam material, elastic polyurethane (PU) material, latex foam material, sponge material, polyvinyl chloride (PVC) foam and ethylene-vinyl acetate (EVA) foam material. The support frame 2 is made of commonly available plastic materials such as acrylonitrile butadiene styrene (ABS), polypropylene (PP), polycarbonate (PC) or polyethylene terephthalate (PET). The protective lining 3 is made of fibrous protective material being an outer side of the protective lining 3 and sponge material being an inner side of the protective lining 3 pressed and formed together.

An upper edge of the shoe counter structure 1 is bent outwardly. This structure can enlarge the foot entrance of the shoe counter structure 1 to facilitate quicker wearing of the shoe.

A second tendon accommodating groove 7 which is recessed towards the rear side of the shoe counter structure is formed below the clamping portion 4. The second tendon accommodating groove 7 is used for accommodating a heel of the user's foot, so that the shoe counter structure 1 can better align with the contour of the user's foot, thereby increasing stability and preventing the foot from accidentally slipping out of the shoe.

An outer side of the shoe counter structure 1 is evenly arranged with a plurality of hexagonal pyramids 8 which facilitate taking off of the shoe and at the same time ensuring the overall aesthetic appearance of the shoe. Alternatively, the hexagonal pyramids 8 may be replaced by triangular pyramids or any pyramids with a base more than 3 sides in order to match with different aesthetic designs of the shoe.

Embodiment 2

Figure 4:
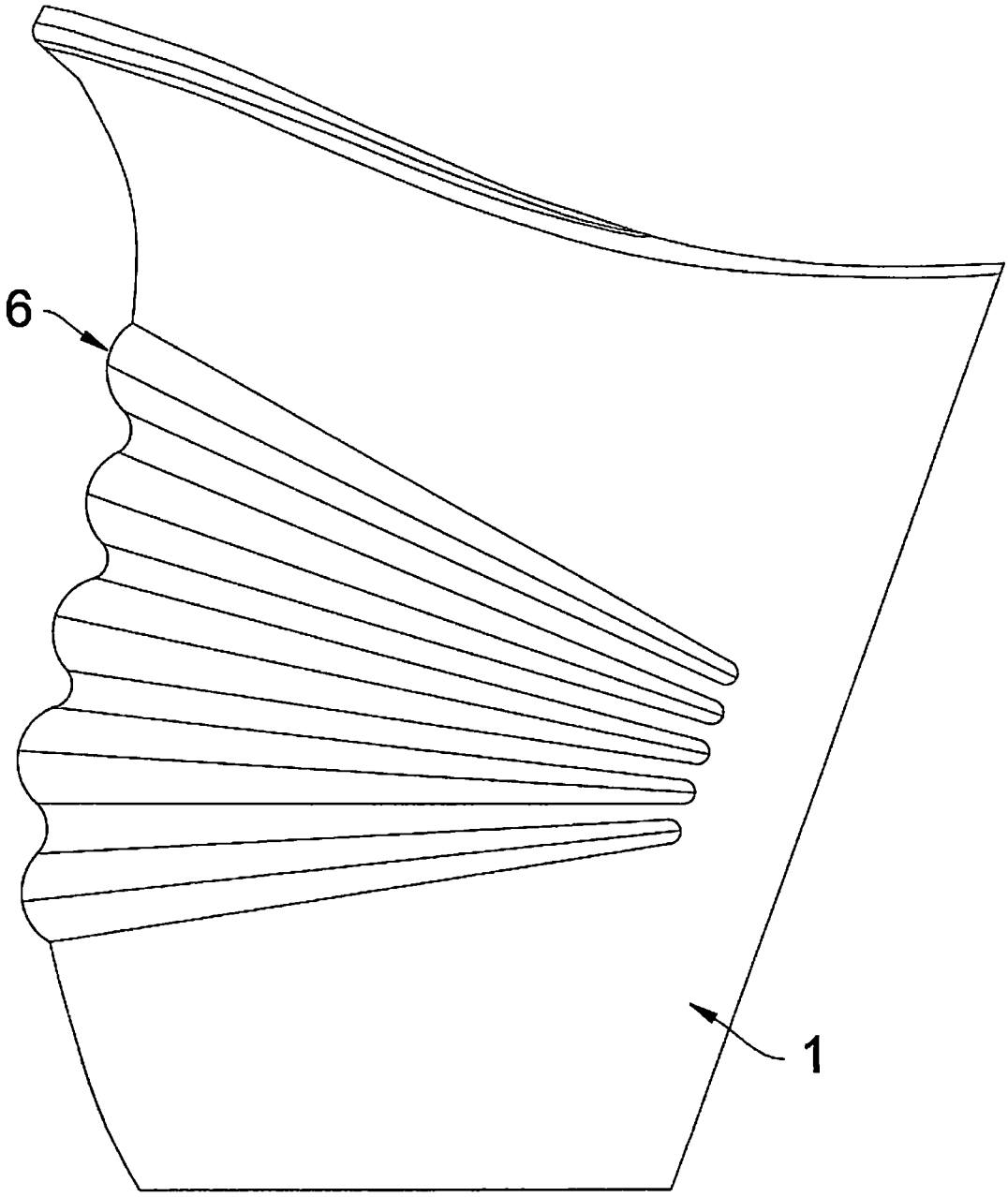
FIG. 4 is a side view of the shoe counter structure according to another embodiment of the present invention.
Figure 5:
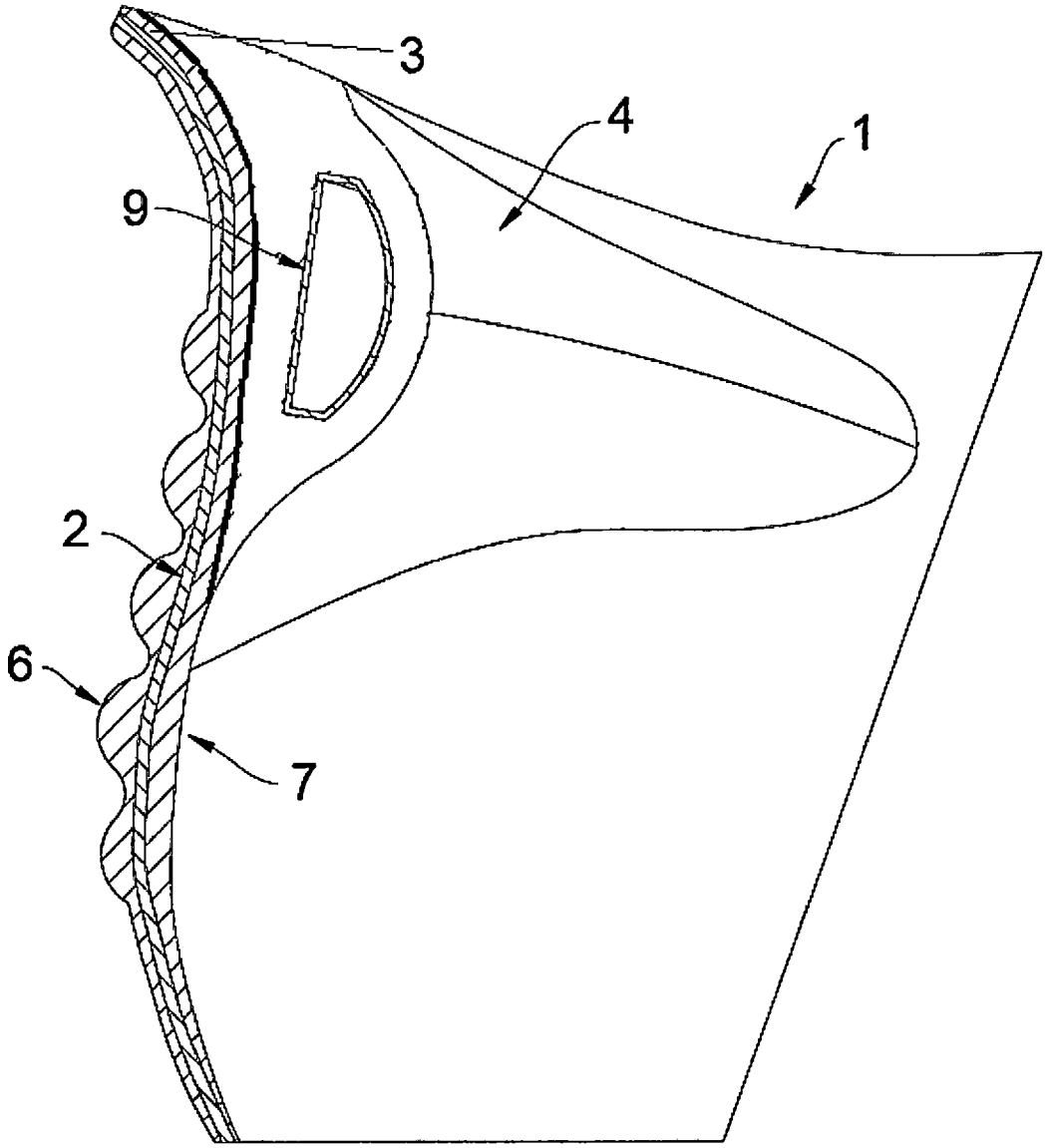
FIG. 5 is a sectional view of the shoe counter structure according to another embodiment of the present invention.
Figure 6:
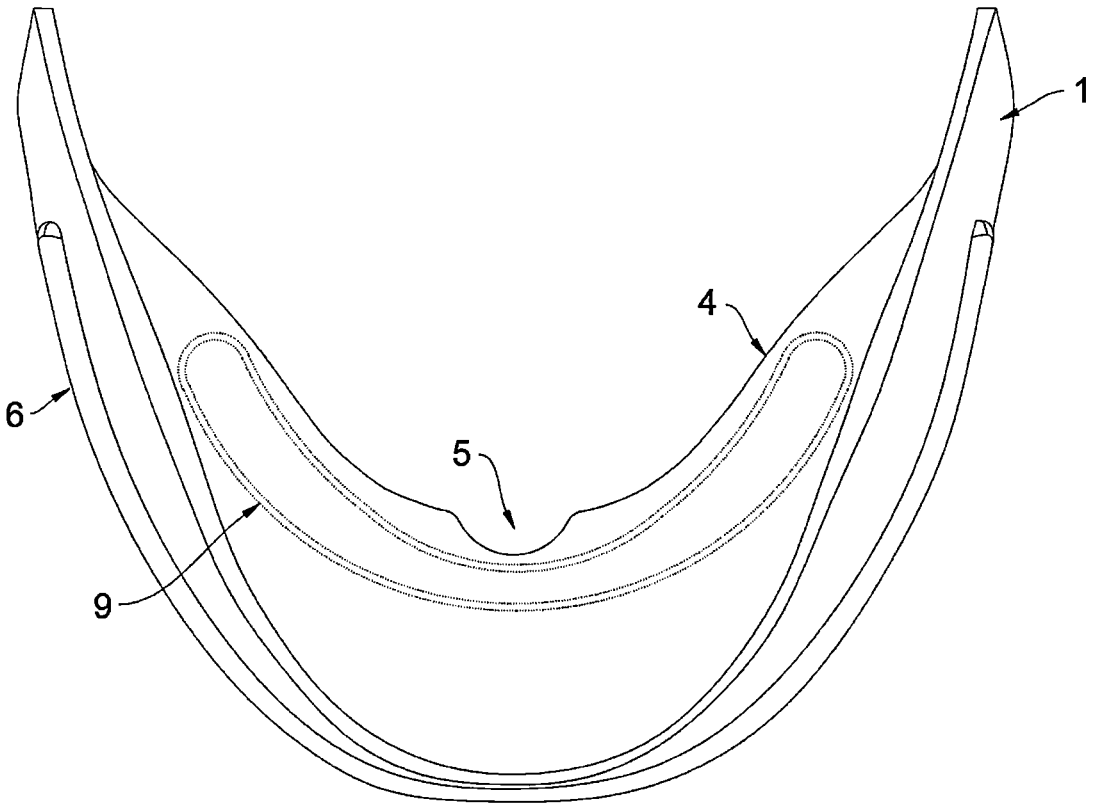
FIG. 6 is a top plan view of the shoe counter structure according to another embodiment of the present invention.

With reference to FIGS. 4-6, embodiment 2 is different from embodiment 1 in that: the hexagonal pyramids 8 of embodiment 1 are replaced by five anti-slippery stripe projections 6 each tapers towards two ends thereof. In actual use, many users will actually take off their shoes using their feet, specifically as an example, to take off a right shoe, user uses a middle part of his left foot to press against the shoe counter of the right shoe so that the shoe counter of the right shoe will not be lifted off the ground, and then the user withdraws his right foot from the right shoe to take off the right shoe (analogously, take off the left shoe by using the right foot in a similar way as described above). If the shoe is taken off in this way, the shoe counter must be pressed against the ground so that the foot can be withdrawn from the shoe. The five anti-slippery stripe projections 6 help increase the frictions created during operation when the shoe counter is being pressed against the ground to avoid any slipping, thus allowing quicker taking off of the shoe.

A U-shaped airbag 9 is provided inside the clamping portion 4; a thickness of two ends of the U-shaped airbag 9 is greater than a thickness of a middle part of the U-shaped airbag 9. Compared with sponge material, the airbag 9 can achieve stability better and will not easily age or collapse, thereby good at stably supporting the ankle.

Embodiment 3

Figure 7:
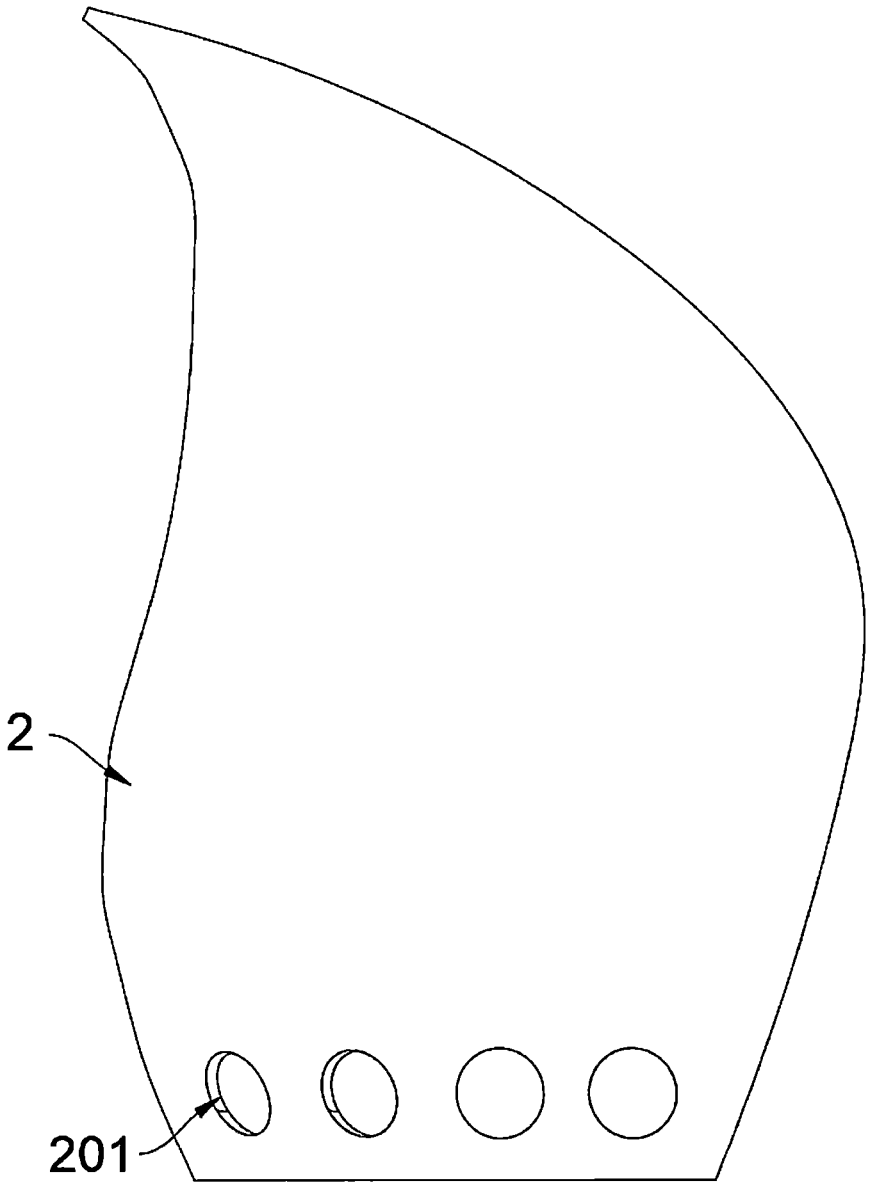
FIG. 7 is a side view of the support frame of the shoe counter structure according to a third embodiment of the present invention.

With reference to FIG. 7, a lower portion of the support frame 2 is evenly distributed with eight air holes 201. The air holes 201 are used for increasing the breathability of the shoe so as to ensure comfort of wearing the shoe.

The more preferred embodiments of the present invention are described above. However, they are not intended to limit the present invention in any sense. Although the more preferred embodiments are described, the present invention is not limited to be implemented only according to the described embodiments. Any person skilled in this field of art are able to make non-inventive changes and modifications to obtain alternative configurations that constitute other embodiments of equivalent technical effects based on the above disclosure and without departing from the scope of the present invention. Any changes and modifications that are intended to achieve the equivalent technical effects, made in accordance with the teachings of the present invention and without departing from the scope of the present invention, should also fall within the scope of the present invention.

What is claimed is:

1. A shoe counter structure, wherein a cross sectional shape of the shoe counter structure is curved as a C-shape; said shoe counter structure comprises a support frame and a protective lining adhered to and covering an inner side of the support frame; an inner upper portion of the support frame is provided with a U-shaped clamping portion; two sides of the clamping portion are inclined outwardly towards two sides of the shoe counter structure, a middle part of the clamping portion is recessed inwardly towards a rear side of the shoe counter structure to form a first tendon accommodating groove; a second tendon accommodating groove which is recessed towards the rear side of the shoe counter structure is formed below the clamping portion;

a U-shaped airbag is provided inside the clamping portion; a thickness of two ends of the U-shaped airbag is greater than a thickness of a middle part of the U-shaped airbag.

2. The shoe counter structure of claim 1, wherein an upper edge of the shoe counter structure is bent outwardly.

3. The shoe counter structure of claim 1, wherein an outer side of the shoe counter structure is evenly arranged with a plurality of anti-slippery stripe projections.

4. The shoe counter structure of claim 3, wherein each of the anti-slippery stripe projections tapers towards two ends thereof.

5. The shoe counter structure of claim 1, wherein an outer side of the shoe counter structure is evenly arranged with a plurality of hexagonal pyramids.

6. The shoe counter structure of claim 1, wherein a lower portion of the support frame is evenly distributed with a plurality of air holes.

* * * * *